United States Patent [19]

Kashuba, Jr.

[11] 3,961,744

[45] June 8, 1976

[54] COIN COLLECTING SYSTEM FOR PARKING METERS

[75] Inventor: Andrew Kashuba, Jr., Secaucus, N.J.

[73] Assignee: Henry R. Stiffel, River Vale, N.J.

[22] Filed: Apr. 23, 1975

[21] Appl. No.: 570,563

[52] U.S. Cl. ..... 232/16
[51] Int. Cl.[2] ..... G07D 9/00
[58] Field of Search ..... 232/16, 15, 4 D

[56] References Cited

UNITED STATES PATENTS

| | | | |
|---|---|---|---|
| 382,867 | 5/1888 | Claspy | 232/15 |
| 432,610 | 7/1890 | Hagerty | 232/15 |
| 917,256 | 4/1909 | Cox | 232/15 |
| 1,011,815 | 12/1911 | Kohler | 232/16 |
| 2,008,119 | 7/1935 | Williams | 232/4 D |
| 2,465,431 | 3/1949 | Cisenfeld | 232/4 D |
| 2,815,166 | 12/1957 | Sollenberger | 232/16 |

*Primary Examiner*—Roy D. Frazier
*Assistant Examiner*—William E. Lyddane
*Attorney, Agent, or Firm*—Ralph R. Roberts

[57] ABSTRACT

A central coin collection receptacle having a locking and an unlocking mechanism utilizes a push-pull motion into a guide chute to provide a precise sequential operation for the opening and closing of a key-operated coin box. The opening procedure includes detecting for a full insertion of a key into the lock of the coin box, the fully unlocking of the coin box before the opening of a trap door in the coin box and a controlled opening of the trap door for releasing the coins. A reverse procedure occurs in the closing and locking of the coin box.

10 Claims, 11 Drawing Figures

COIN COLLECTING SYSTEM FOR PARKING METERS

BACKGROUND OF THE INVENTION

1. Field of the Invention

With reference to the classification of art as established in the United States Patent Office this invention pertains to apparatus as found in the general Class entitled, "Deposit and Collection Receptacles" (Class 232) and more particularly in the subclasses entitled, "fare boxes - safety receptacle" (subclass 15) and the subclass thereunder entitled, "auxiliary" (subclass 16).

2. Description of the Prior Art

Coin boxes with a locking trap door are well known and in particular coin boxes for parking meters whose locked trap door is unlocked by insertion of a key into a locking mechanism of the coin box. However, in many of the present systems commerically used, difficulty is encountered in insuring that the coins are delivered from the coin box only to the locked receivers. Other objections to the presently available systems include key breakage or bending due to a malfunctioning of the system or the absence of a positive closure of the opened trap door before this trap door is locked.

SUMMARY OF THE INVENTION

The present invention may be summarized at least in part with reference to its objects.

It is an object of this invention to provide, and it does provide, a coin collection system having a locked receiving receptacle which includes means to open, close and receive the contents of a key-operated coin box. The collecting receptacle includes a chute preferably inclined at an angle which guides the coin box to and onto a key. Inward movement of the box results in rotation of this key which as it is rotated unlocks the coin box and releases the door to open. The outward withdrawal of the coin box actuates a roller which closes the door prior to the locking thereof.

It is another object of this invention to provide, and it does provide, a central coin collection system which receives, opens and closes key operated coin boxes. The collecting receptacle has an interlocking means which detects the desired penetration of a key into the key slot of the coin box. This interlocking means insures that rotation of the key is prevented unless the interlock is engaged. In this manner this invention prevents the key from being bent, twisted or broken.

It is a still further object of this invention to provide, and it does provide, a central coin collection receptacle adapted to receive and open key operated coin boxes. The collection receptacle includes a resiliently mounted roller which is movable into the path of the infed box to automatically adjust for the typical variation in sizes of the coin boxes. This automatic adjustment also insures a positive closing of the trap door at all times before actuating the lock of the coin box. The resiliently mounted roller further provides an improved means for aligning the key with the key slot and an easier unlocking and locking of the coin box.

This invention provides a coin collecting system which usually, but not essentially, is carried on a cart of like transport. The receiver box member is removably supported by the frame of this cart and includes the coin collection receptacle which usually remains locked during the time of collection of the receipts from the parking meter boxes. The locked box, as used in the individual parking meters, is removed from the parking meter and with that end of the coin box containing the lock is slid into a chute portion of the collection system. A pressure roller urges the box, as it moves in the chute, into a precise entering path during which the keyway of the coin box lock engages and allows a key to enter this lock. An interlock is engaged by the coin box and must be actuated before a barrel cam associated with the key is permitted to rotate to turn the key. The turned lock causes a bolt to open a trap door in the coin box allowing the coins to drop into the collecting receptacle before relocking the coin box. A lost motion action provided in this cam insures that the trap door of the coin box is moved to its closed condition before the cam and associated key is turned to lock the door of the now empty coin box which is then removed from the collection system and returned to the parking meter.

In addition to the above summary the following disclosure is detailed to insure adequacy and aid in understanding of the invention. For this reason there has been chosen a specific embodiment of the coin collection system for parking meters as adopted for use with locked coin boxes. This specific embodiment has been chosen for the purposes of illustration and description as shown in the accompanying drawings wherein:

BRIEF DESCRIPTION OF THE DRAWINGS

In the following description and in the claims various details are identified by specific names for convenience. These names, however, are intended to be generic in their application. Corresponding reference characters refer to like members throughout the several figures of the drawings.

The drawings accompanying, and forming part of, this specification disclose details of construction for the purpose of explanation but it should be understood that these details may be modified without departure from the invention.

DESCRIPTION OF THE PREFERRED EMBODIMENT

Figure 1:
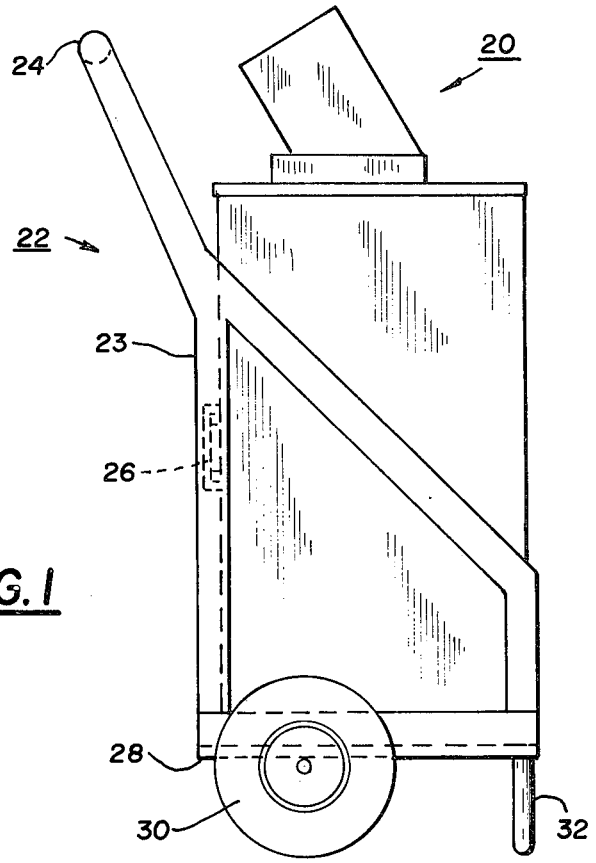
FIG. 1 represents a side view of a central coin collecting receptacle mounted on a wheeled frame.

Referring to the drawings and in particular to the general arrangement of FIG. 1, there is shown a central coin collecting receptacle 20 mounted and carried by a cart 22. The cart 22 is of a conventional design having a pair of side frames 23 held in spaced relationship to each other and includes a handle 24, a cross member 26 and a base member 28. The cart 22, as shown, has a pair of wheels 30 and a resting foot 32. The collecting receptacle may be removably secured to the cart frame by employing a conventional hook means which may be used in combination with cross member 26.

CHUTE GUIDE OF FIG. 2

Figure 2:
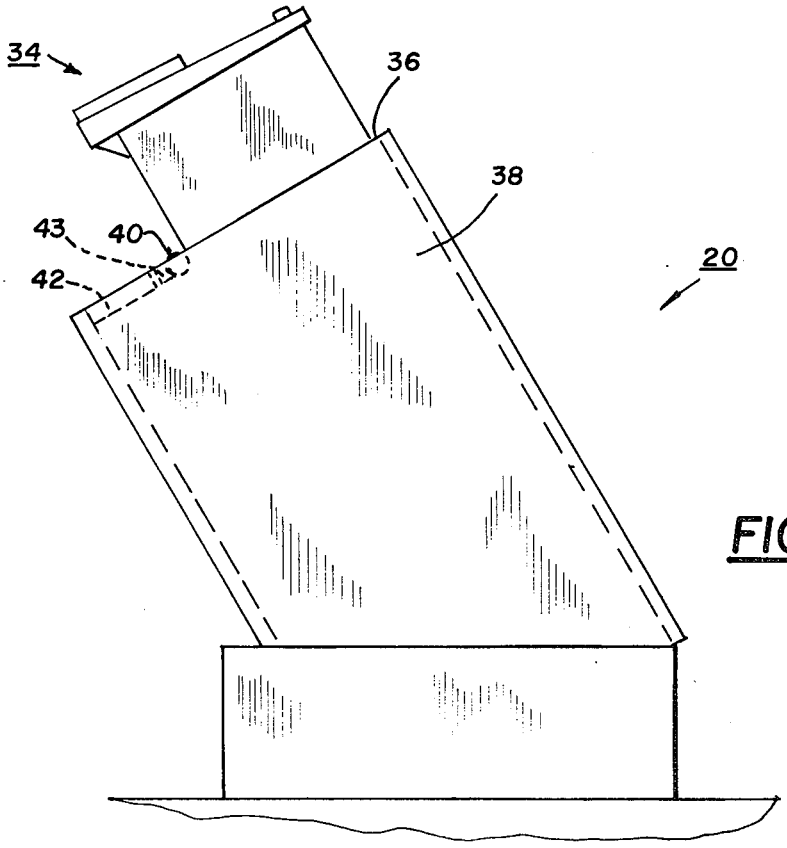
FIG. 2 represents an enlarged view of the coin collection receptacle and showing a coin box in initial inserting position and ready to be unlocked by the key actuating or turning mechanism.

Referring next to FIG. 2, there is diagrammatically depicted a coin box 34 slidably inserted into the open end 36 of a receiving chute portion 38 of the coin collecting receptacle 20. In this chute is mounted a resilient roller 40 which engages the underside of and positions this inserted coin box 34 which is to be emptied. The support block 42 carries a spring-biased movable clevis 43 and this roller 40.

KEY ACTUATING MECHANISM OF FIG. 3

Figure 3:
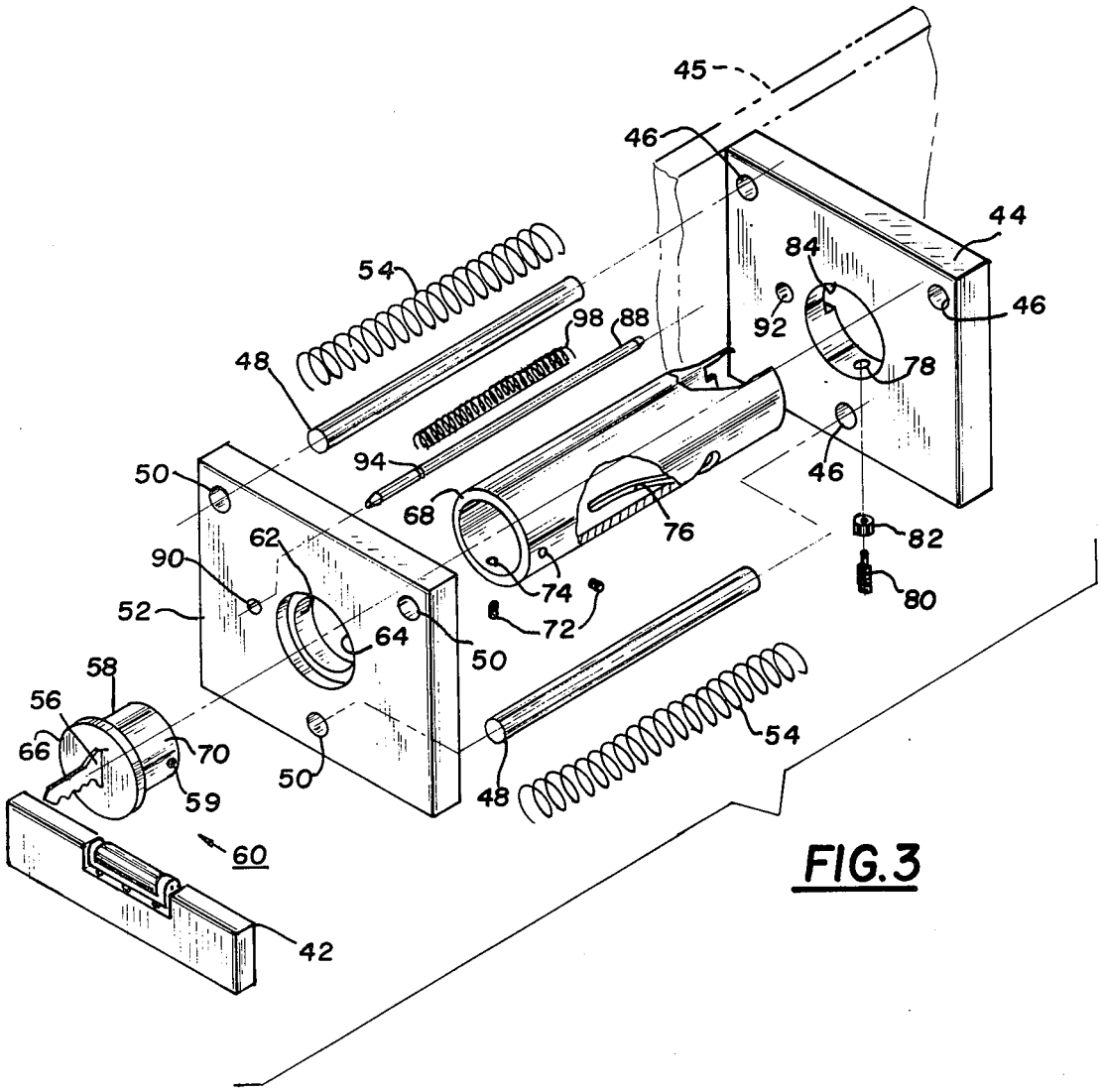
FIG. 3 represents an isometric exploded view of the key turning mechanism and an associated interlock safety mechanism.

FIG. 3 is an exploded view in which there is shown a stationary base member 44 held in spaced relationship to the front support plate 42 by side walls 45. Cylindrical bores 46 are formed in the stationary base member 44 and provide a sliding guide means for rods 48 which are press fit into cylindrical bores 50 in the movable face member 52. Compression springs 54 are carried by and on these guide rods and these partially compressed springs urge the movable member 52 to an established outer limit. The support block 42 also provides a positive stop for the outer movement of movable member 52. A key 56 is removably secured in a key hub 58 by means of a set screw 59 and with the key is identified as hub assembly 60. This hub assembly 60 is movable with and is rotatable in a bore 62 of the movable member 52. A counterbore 64 in the face of this movable member 52 receives the enlarged portion 66 of the hub 58 and in seated condition the outer face of hub 58 is substantially flush with the face of the movable member 52. This enlarged portion, as it is seated in counterbore 64 acts as and provides an outer limit stop shoulder restricting the rightward longitudinal movement of the hub 58 in bore 62.

A barrel cam 68 has its foreportion mounted on a reduced diameter portion 70 of the hub 58. This cam is secured to the hub assembly by set screw 72 which is also mounted in a threaded hole 74 in the key hub 58. The front face of the mounted cam 68 engages the rear surface of the movable member 52 to provide the leftward or other longitudinal shoulder stop of the cam and hub assembly. This rear stop cooperates with the shoulder portion of the hub assembly to retain the cam and hub assembly in a rotatable but fixed position with respect to the movable front member while moving therewith. A cam track 76 is formed in the barrel cam 68 and for a greater portion has a quarter turn helix as a cam path which terminates at a straight portion formed at the upper or left end of the cam path. This straight portion is parallel to the axis of the barrel cam and, as reduced to practice, is about one-half inch in length. A threaded aperture 78 is formed in the stationary base plate 44 and mounted therein is a follower support pin 80 on which a rotatable cam follower 82 is mounted. This cam follower 82 is slidable in the cam track 76 and as the barrel cam is moved back and forth in bore 84 this fixed position cam follower 82 causes the barrel cam 68 to be rotated in accordance with the convolution of the cam track 76.

OPERATION OF THE APPARATUS OF FIGS. 2 AND 3

When and as an inward force is applied to the movable member 52 to cause this member to be moved toward the stationary base member 44, the barrel cam 68 which is engaged by the fixed position cam follower 82 is rotated in accordance with the convolution formed in the cam track 76. The distal end of the barrel cam 68 is journaled in and is slidable in bore 84 in stationary member 44. As the member 52 is moved the cam 68 is longitudinally movable through the stationary member 44 and cam follower 82, which is retained by this follower support pin 80, and moves along the cam track 76 as the barrel cam is moved through the bore 84. The cam follower 82, as it engages the cam track 76 of the barrel cam 68, imparts a rotational motion to the barrel cam 68 which imparts such motion to the key hub assembly 60. The forward or left portion of the cam track 76, which is approximately one-half inch in length, is made parallel to the axis of the barrel cam 68 so that no rotational motion is imparted to the barrel cam during the latter portion of the inward stroke of the movable member 52. After the forward movement of the movable member has been completed by reaching a determined stop the coin box is opened, after which the inward push is removed and the compression springs 54 return the movable member to its original outer position against the fixed plate 42.

DESCRIPTION OF THE EMBODIMENT OF FIGS. 4 & 5

Figure 4:
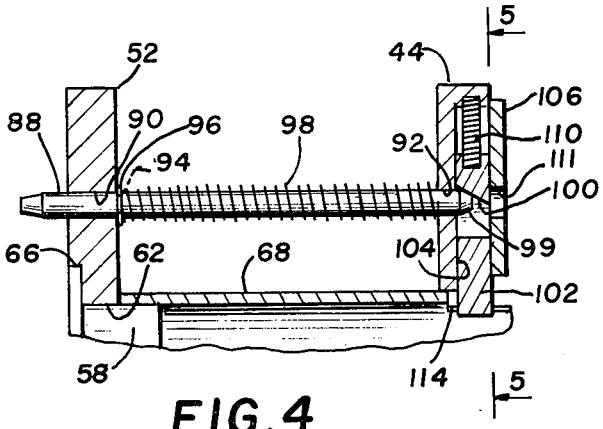
FIG. 4 represents a sectional view of the interlocking system, this view taken along line 4—4 of FIG. 3.
Figure 5:
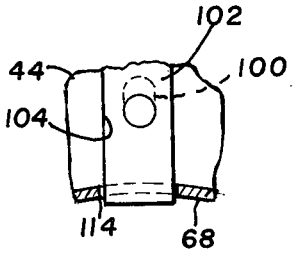
FIG. 5 represents a fragmentary view of the barrel cam lock, this view taken on the line 5—5 of FIG. 4 and looking in the direction of the arrows.

Referring next to the sectional view of FIG. 4 and the fragmentary view of FIG. 5, there is shown a partly schematic arrangement in which an inner lock actuator pin 88 is slidably journaled in a cylindrical bore 90 formed in the movable member 52. The engaging or left-hand end of the actuator pin 88 normally extends beyond the front face of member 52. The right or inner end of the actuator pin 88 is slidable in a like-sized bore 92 formed in stationary base member 44. An annular groove 94 is formed in this actuator pin and mounted in this groove is a spring-type retaining ring 96 which provides a limiting stop against the leftward movement of the actuator pin 88. A compression spring 98 is slidably fit on this actuator pin 88 and at its left end engages the retaining ring 96 to urge the actuator pin 88 leftwardly toward the movable plate 52. The other or right end of spring 98 engages the fixed plate 44. A right tapered end 99 of actuator pin 88 fits into a tapered recess 100 formed in latch bar 102. This latch bar is slidably retained in a guideway or recess 104 formed in the stationary plate 44 and is retained by a cover member or plate 106. The tapered recess 100, which is formed in the latch bar 102, is engaged by the tapered end 98 of the actuator pin 88 and with its rightward movement urges the latch bar 102 upwardly against the bias of spring 110. An aperture 111 is formed in the cover plate 106 and is aligned with the aperture 92 formed in fixed plate 44. This permits rightward movement of pin 88 causing the bar 102 to be moved to an upward position by the camming action of the actuator pin 88 as the tapered end 99 passes through tapered recess 100 and into the aperture 111.

OPERATION OF THE ACTUATOR PIN OF FIG. 4 & FIG. 5

Actuator pin 88 is engaged by the face of the incoming coin box 34 and with this inward movement the projecting portion of the actuator pin 88 is caused to move rightwardly against the bias of spring 98 causing the tapered end of the pin 88 to engage the recess 100 in latch bar 102 and move it upwardly as the tapered end 99 moves into and through the tapered aperture 100. As the latch bar 102 is moved upwardly a disengagement of the lower end of bar 102 in a notch recess portion 114 of the barrel cam 68 occurs. The inward or rightward position of the actuator pin raises the latch bar 102 which releases the locking action on the barrel cam thus allowing it to rotate. The inward movement of the movable member 52 causes the key 56 to enter the lock of the coin box and shortly thereafter or with the key fully entered the actuator pin has now been moved so as to be flush to the face of member 52 and the latch bar 102 is moved from its locking engagement with the barrel cam. Further inward movement of the member 52 by pushing of the coin box causes the barrel cam and key to rotate and in this manner causes a rotation of the lock in the coin box. After the coin box has been emptied and is to be removed from the collecting system, the withdrawal of the coin box allows the springs 86 to push the movable member 52 leftward or to its initial position. With this movement and at the same time, the actuator pin 88 is moved by spring 98 to move with the movable member. Cam follower 82 engages the track 76 and causes the barrel cam 68 to first remain in a straight condition for one-half inch travel of the cam track and then to rotate and return to its originally oriented position as and when the movable member 52 reaches its full outward position. At this point in the action the actuator pin has assumed the position as seen in FIG. 4 and the latch bar 102 has moved down as in FIG. 5 to cause bar 102 to move into the receiving notch 114 to lock the rotation of the barrel cam 68.

THE COIN BOX OF FIG. 6

Figure 6:
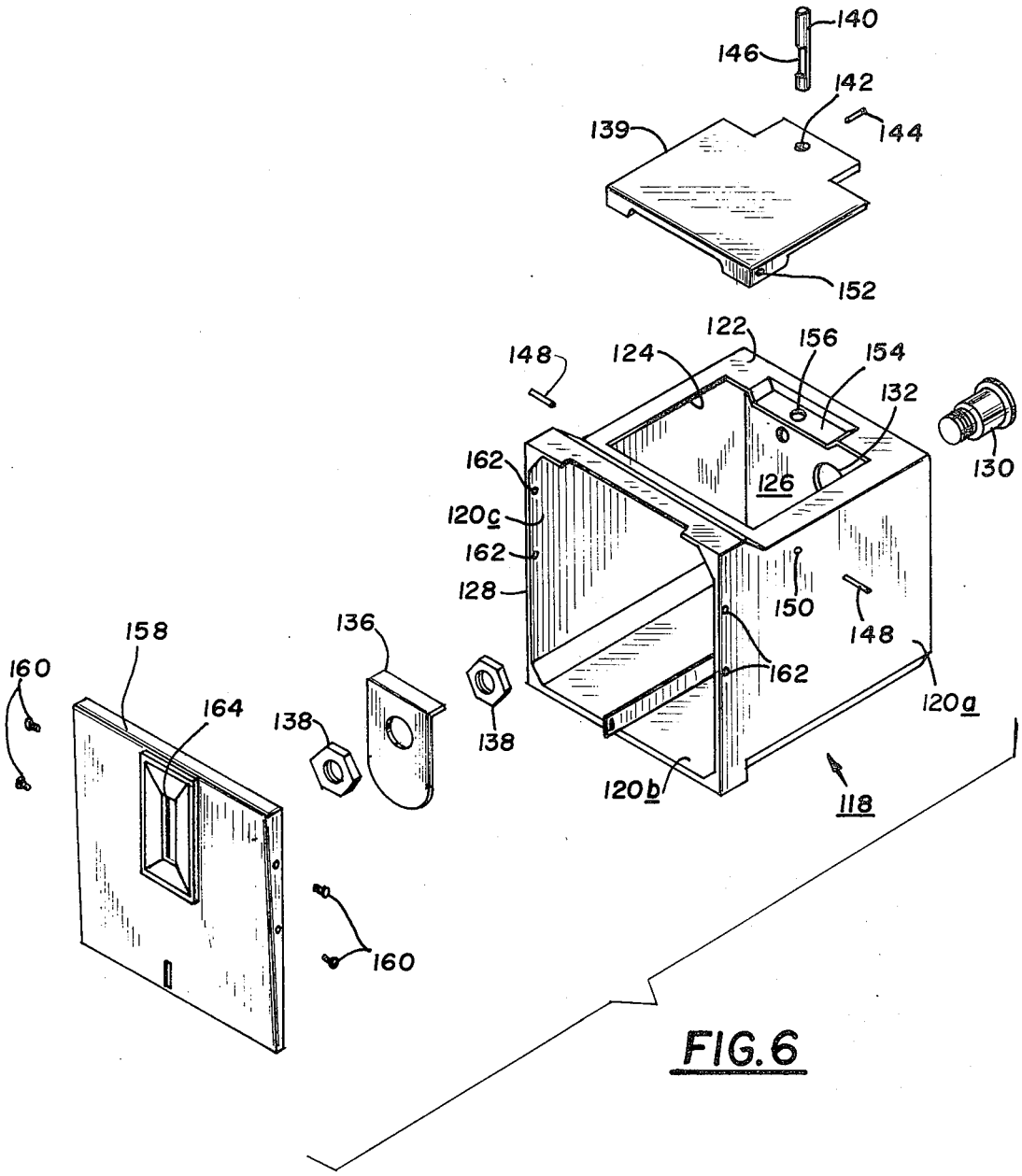
FIG. 6 represents an isometric exploded view of the lock equipped coin box and with this view rotated about one hundred eighty degrees from the attitude of the coin box when positioned for and inserted into the collecting system.

Referring next to FIG. 6, there is shown in exploded view the coin box 34 which includes a housing 118 which preferably is die cast. This housing has solid side walls identified as 120*a*, 120*b* and 120*c*. An upper or other side wall 122 has a rectangular opening 124 therein. A back wall 126 is provided with a lock means, to be hereinafter described. The face of this housing is open and is identified as 128. A lock mechanism 130 is mounted in an aperture 132 formed in the back wall 126 and is retained by any suitable means. A latching arm or bracket 136 is secured on the threaded portion of the locking mechanism 130 by a pair of hex nuts 138 and by a key means or the like is fastened in position so as to positively turn with the turning of the lock 130. A trap or movable door 139 is mounted on upper side wall 122 and one end of this door carries a lock pin 140 which is secured in bore 142. This pin is mounted in and is retained in this bore by means of a lock or key pin 144.

It is to be noted that stop pin 140 has a flat portion 146 formed on its near face, this flat portion is adapted to receive the inward extending bent tab portion of the latch bracket 136. The trap door 139 is held in pivoted or hinged relationship to the aperture portion of the side wall by means of hinge pins 148 which are mounted in drilled holes 150 in the housing 118. These pins are also mounted in and extend into mating bores 152 of the trap door 139. A receiving recess or shoulder stop 154 is formed in the upper side wall 122 and receives the tongue portion of trap door 139, this tongue portion also carries the lock pin 140. An aperture 156 is formed in this recess portion 154 and is disposed so as to allow the free passage therethrough of the lock pin 140 as it enters the interior of the housing 118 when and as the trap door 139 is in the closed position. A box cover 158 closes the open end 128 of the housing 118 and is secured to the housing by means of screws 160 which engage apertures 162 in the side walls 120*a* and 120*c*. In the cover is formed an opening 164 through which the coins are fed and usually, but not necessarily, there are metal flags or fingers which are interiorly positioned and associated with this opening. These flags are hinged to prevent the pushing, shaking or removing of the coins by attempting to cause the coins in the box to pass outwardly through the slot. This method of preventing the shaking of coins out of coin boxes is well known and no patentable significance is ascribed thereto.

OPERATION OF THE COIN BOX OF FIG. 6

In normal operation the coin box 34 is assembled and locked and when it is slid into the coin collecting system for emptying it is rotated one hundred and eighty degrees from the position shown in FIG. 6. When so arranged, the trap door 139 is on the bottom side and is opened by gravity when it achieves its unlocked position. Key 56, seen in FIG. 3, enters the lock mechanism 130 and causes rotation of this lock which as the lock is rotated moves latching arm 136 from the position as indicated in FIG. 6 to a position approximately 90° therefrom. When the lock 130 is turned by the key approximately 90° the inwardly turned upward edge of the latching arm 136 is moved from the flat 146 of the pin 140 allowing the trap door 139 to swing down and to an open condition and to release those coins in the coin box which then drop into the collection box or collecting system.

The trap door 139 must be pushed back into position before the key is turned back to its closed position or else the coin box will be unlocked with the withdrawal of the coin box from the collecting system there is provided a positive lost motion closing of the trap door before the actuation of the lock and this is shown in the following embodiment.

DESCRIPTION OF THE EMBODIMENT OF FIG. 7

Figure 7:
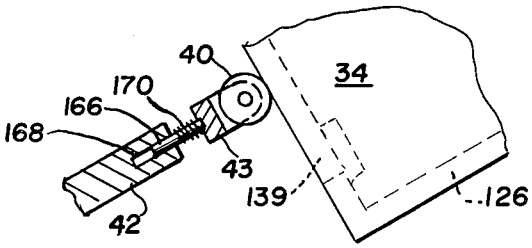
FIG. 7 represents in an enlarged sectional view a resiliently mounted roller for positively guiding the coin box in and into the chute.

Referring now to FIG. 7, there is shown a roller 40 which is carried in a clevis 43. Guide pins 166 are seen in this fragmentary view and are slidable in bores 168 formed in the base 28. Clevis 43 is movable back and forth in the support bar 42 and the roller 40 carried by this clevis is urged outwardly by means of compression springs 170. As thus urged, the roller is positioned outwardly from the lower edge of the support bar 42. A positive stop is provided but is not shown which limits the outer travel of the roller 40.

OPERATION OF THE COIN COLLECTING SYSTEM AS SEEN IN FIGS. 8 THRU 11

Referring next and finally to FIGS. 8, 9, 10 and 11, there is diagrammatically shown a sequence of operation in which the coin box 34 is inserted into the collection system, unlocked, opened, emptied and then during the withdrawal of the coin box the trap door is closed, the lock is actuated to lock the coin box and withdrawal of the locked box is made.

Figure 8:
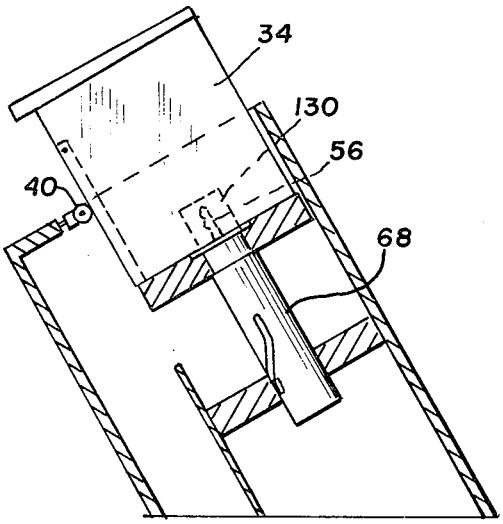
FIG. 8 represents a partly diagrammatic sectional side view of the components of FIG. 2 showing the key and its turn operating mechanism in initial engagement position.

In FIG. 8, coin box 34 has been inserted into the receiving end of the chute and key 56 has entered into the lock mechanism 130. Roller 40 has engaged the underside of the coin box 34 to urge the coin box against the upper portion of the chute. This upwardly biased movable roller accommodates any irregularity in size of the coin box so that the upper side of each coin box is aligned with and slidable along the chute as it is moved inwardly. The actuator pin 88 of FIG. 4 is pushed backward to be brought flush with the face of the movable member 52 and the tapered portion 99 moves the latch bar 102 from the retaining notch 114 in the barrel cam and upwardly to release the barrel cam 68.

Figure 9:
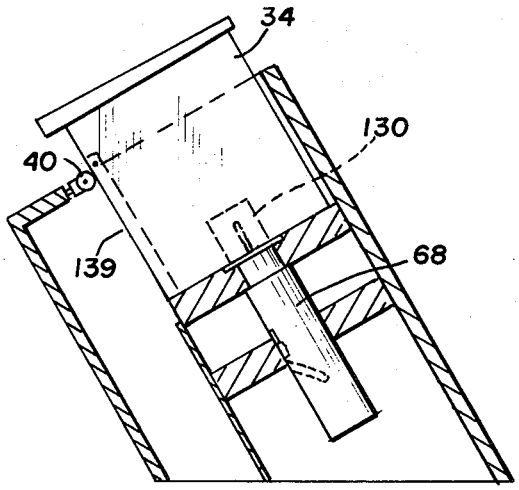
FIG. 9 represents a partly diagrammatic view of the components of FIG. 8 with the coin box partially inserted and with the key rotated about ninety degrees thus providing an unlocking of the trap door of the coin box.

Referring next to FIG. 9, the coin box 34 is shown as having been moved downwardly to within the one-half inch lost motion provided by the cam path in the barrel cam 68. The rotated cam and associated key has turned the lock 130 so that the member 136 is turned from in way of the lock pin whereupon the trap door 139 is released. As the trap door 139 has not fully passed the roller 40, the trap door does not fall open at this point of travel.

Figure 10:
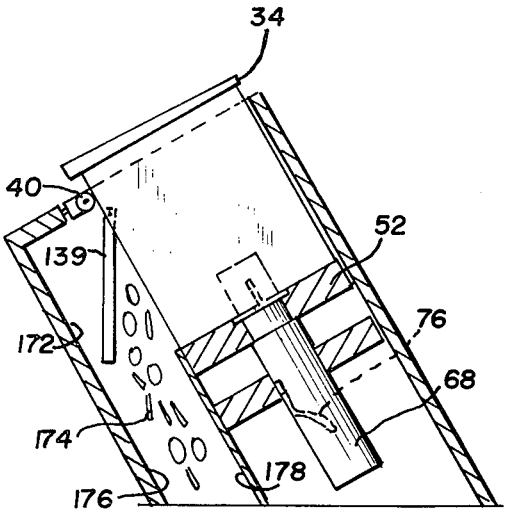
FIG. 10 represents a partly diagrammatic sectional view of the components of FIG. 8 with the coin box now fully inserted allowing the trap door to open releasing the coins.

Referring next to FIG. 10, it is assumed that the coin box 34 has been entered to the full extent into the chute and movable member 52 has reached its full inward extent whereupon the trap door 139 has passed the roller 40 allowing the now unlocked trap door to swing down to open condition and the coins in the box to drop from the box and into chute guideway 172. It is to be noted that the barrel cam 68, during this last portion of the inward movement, continues to move with the movable member 52 but since the desired rotation of the key has been completed the longitudinal straight portion of the cam track 76 is employed and further turning of the barrel cam is not imparted nor is there any turning motion to the key and engaged lock. The open trap door releases coins 174 which fall into the receiving portion of the collecting system. This chute includes the lower wall 176 and gapped intermediate wall 178 which slidably supports the coin box during its inward and outward movement.

Figure 11:
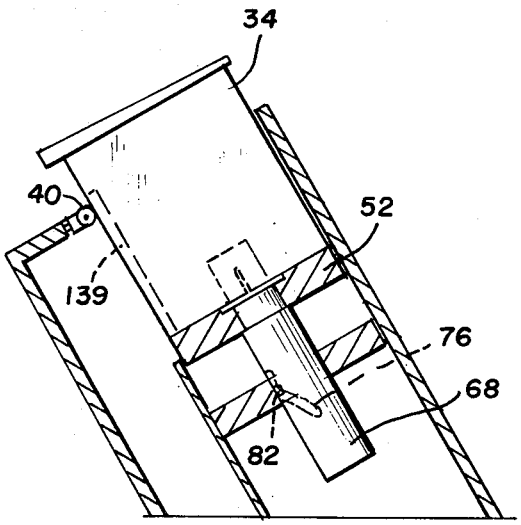
FIG. 11 represents a partly diagrammatic view of the components of FIG. 10 with the coin box partially retracted causing the trap door to be fully closed prior to the rotation of the key.

Referring next and finally to FIG. 11, it is to be noted that after the coins have been removed the coin box 34 is moved outwardly as by means of the springs 86 which urged the movable member 52 outwardly. During this movement the straight portion in the cam track 76 permits outward motion but no turning of the key until the trap door 139 is brought in way of the roller 40 which urges said trap door 139 into a closed condition prior to the turning of the lock. During this determined lost motion travel the trap door is urged into a fully closed condition and further outward motion of the coin box provided by the movable front member 52 and the compression springs causes the barrel cam 68 to be rotated as it is engaged by the cam follower 82. This fixed follower as it moves in the helix portion of the barrel cam turns key 56 so that with the rotation of the cam the key is caused to be turned causing the lock 130 and the latch bar 136 to move back into a locking position whereafter with a continued outward motion the emptied but locked coin box 34 is now removed from the chute.

The above-described coin collecting system provides a coin chute which has a spring-biased roller which engages the underside of the entering coin box and accommodates the manufacturing inaccuracies of boxes which customarily exist. This roller additionally engages the trap door of the box to insure that it does not prematurely open and that the door is closed before the relocking actuation is achieved. The lost motion portion of the cam insures that the coin box door is closed before the lock is turned to relock the box. The interlock employed insures that the key is fully entered before the barrel cam is turned. The simple push-pull action to empty the coin box is very simple and requires no elaborate auxiliary equipment. As reduced to practice, the on the job experience of participating municipalities has proved and confirmed the excellence and simplicity of the above-described collecting system.

Terms such as "left," "right," "up," "down," "bottom," "top," front," "back," "in," "out" and the like are applicable to the embodiment shown and described in conjunction with the drawings. These terms are merely for the purposes of description and do not necessarily apply to the position in which the coin collecting system and coin boxes may be constructed or used.

While a particular embodiment of this system has been shown and described it is to be understood modifications may be made within the scope of the accompanying claims and protection is sought to the broadest extent the prior art allows.

What is claimed is:

1. A coin collecting apparatus for automatically unlocking and opening locked coin boxes and during the opening of said box receiving and retaining the coins therefrom and after the box has been emptied the box is removed from the apparatus and during removal the box is closed and relocked, the collecting apparatus includes a receiving chute into which the locked box is placed and during a reciprocating push in, pull out operation this chute retains the box in its inserted and oriented condition while the box is unlocked, opened, closed and relocked, the chute having an opening associated therewith, said opening in communication with a coin accumulating means, the coin collecting apparatus including: (a) a guide chute having sides and a top and bottom surface providing a slide and guide means of determined extent; (b) an end member fixedly carried in said chute and substantially transverse to the axis of the chute; (c) a movable member carried in the chute and disposed intermediate the open end of the chute and the fixed end member; (d) sliding and guiding means for maintaining the movable member substantially normal to the axis of the chute while at both ends of its limit of movement and during movement of the movable member toward and from the fixed member; (e) biasing means for urging the movable member to and toward the open end of the chute; (f) a barrel cam carried by and with the movable member, said cam having a cam track formed to include a quarter turn helix with one end of the helix track portion continuing with a straight portion in axial alignment with the axis of the cam; (g) a cam follower in association with and in engagement with the cam track and so retained that with the movement of the movable member the barrel cam is rotated to correspond to the radial displacement of the cam track with reference to a theoretical line parallel to the axis of the cam; (h) a key associated with and rotatable with the barrel cam, said key oriented so as to enter the keyway of the lock of the coin box when said coin box is entered into the chute with the door thereof positioned downwardly and whereby when the coin box is entered in the chute the keyway of the lock of the coin box slides along the key to achieve the desired penetration of the keyway; (i) an interlock which includes a lock means which engages the barrel cam to prevent rotation thereof until the interlock is activated and said lock means being removed with and by bringing the coin box adjacent to the movable member and maintaining the coin box thereat during the key insertion into the lock of the coin box after which the face of the coin box as it moves forwardly urges the movable member toward the end member, said movement causing the cam follower to rotate the barrel cam and the associated key to turn the lock and release the door which opens into the opening in the guide wall and remains open during the movement of the cam follower in the straight portion of the cam track, and by and with the biasing means the movable member and coin box is moved toward the open end of the chute, the straight portion of the cam track enables the door to be fully closed by the chute guide means before the helix portion of the cam track is engaged to cause the key and lock to be turned to lock the coin box, and (j) an opening in the bottom guide wall and guide means of the chute, said opening corresponding to a gravitational opening of the door in the coin box to permit the door to swing downwardly and the coins in the box to fall from the open box.

2. A coin collecting system as in claim 1 in which the interlock includes an actuator pin carried by and slidable in an aperture in the movable member, said actuator pin having a determined portion extending beyond the face of the movable member, the other end of the actuator pin disposed to cam from lock engaging position a latch member having an engaging means which cooperates with a receiving means formed in the barrel cam, the inward movement of the actuator pin as urged by the bringing of the coin box adjacent the movable member causing the camming of the latch member from lock engaging position of the barrel cam.

3. A coin collecting system as in claim 2 in which the actuator pin is biased toward the movable member.

4. A coin collecting system as in claim 2 in which the lock means on the latch member is a lug and the cooperative locking means on the barrel cam is a mating notch formed therein and the latching member as moved by the camming means on the actuator pin is disengaged only after the actuator pin has been moved to a position corresponding to a full insertion of the key into the lock in the coin box.

5. A coin collecting system as in claim 3 in which the cam means provided by the actuator pin is a tapered end portion and on the latching member there is formed a cooperatively tapered recess and an associated passageway for the entrance thereinto of the actuator pin during the time it is moved into the lock means disengaging condition.

6. A coin collecting system as in claim 2 in which the lower portion of the chute includes a biased guide means which is positioned in way of the path of the coin box as it is moved into the chute, this biased guide means urging the engaged coin box against the upper guide surface of the chute, the biased urging of said guide means in said guide path accommodating the manufacturing tolerances of the coin boxes and establishing a precise guide path of and for the coin box to insure easy entrance and withdrawal of the key in the lock keyway.

7. A coin collecting system as in claim 5 in which the biased guide means includes a roller carried by a clevis-type support, said roller in addition to movement into the guide path and engaging the undersurface of the coin box also disposed to engage the opened coin box door and during the withdrawal movement of the coin box said opened door is urged by the roller so as to cause the door to be moved into a closed condition before the barrel cam and associated key is rotated.

8. A coin collecting system as in claim 6 in which the straight portion of the cam track is about one-half inch in length and as engaged and moved by the cam follower occurs at the inner one-half inch of movement of the barrel cam and the coin box in the chute.

9. A coin collecting system as in claim 1 in which the movable member is carried by guide rods which are slidably mounted in the fixed end and there is a biasing means associated with the movable and fixed end, said biasing means urging the movable member to a stop adjacent the open end of the chute.

10. A coin collecting system as in claim 1 in which the coin box to be used with this system has a side with a discharge opening therein; a trap door hingedly mounted at one end of the opening and disposed to swing outwardly from the side to uncover said opening and when moved against the side to close said opening; a lock pin secured to and movable with the trap door; an aperture formed in the side wall carrying the trap door, this aperture providing a passageway for the lock pin which is disposed to extend inwardly from the inner face of the closed door and through this aperture in the wall and into the interior of the coin box and a latch bracket carried by the lock of the coin box, the bracket at one limit of movement engaging stop means on said lock pin to hold the door in a closed and secured position and when said bracket is turned about ninety degrees the bracket is disengaged from the lock pin and the door is free to swing open.

* * * * *